US009943865B2

(12) United States Patent
Martiskainen et al.

(10) Patent No.: US 9,943,865 B2
(45) Date of Patent: Apr. 17, 2018

(54) APPLICATOR

(71) Applicant: AM-Tuotanto Oy, Kirkkonummi (FI)

(72) Inventors: Arto Martiskainen, Kirkkonummi (FI); Janne Kuitto, Helsinki (FI); Jarmo Kuitto, Lahti (FI)

(73) Assignee: AM-TUOTANTO OY, Kirkkonummi (FI)

( * ) Notice: Subject to any disclaimer, the term of this patent is extended or adjusted under 35 U.S.C. 154(b) by 46 days.

(21) Appl. No.: 15/045,899

(22) Filed: Feb. 17, 2016

(65) Prior Publication Data

US 2016/0243566 A1 Aug. 25, 2016

(30) Foreign Application Priority Data

Feb. 25, 2015 (EP) ..... 15156544

(51) Int. Cl.
*B65D 88/54* (2006.01)
*B05B 7/24* (2006.01)
(Continued)

(52) U.S. Cl.
CPC ..... *B05B 7/2416* (2013.01); *A45D 19/0008* (2013.01); *A45D 19/16* (2013.01);
(Continued)

(58) Field of Classification Search
CPC .. B05B 7/2416; A45D 19/0008; A45D 19/16; A45D 34/04
(Continued)

(56) References Cited

U.S. PATENT DOCUMENTS 1,838,648 A * 12/1931 Atwood ..... B05B 7/1413 222/630
1,875,729 A * 9/1932 Wolfgang ..... B05B 7/2416 239/351
(Continued)

FOREIGN PATENT DOCUMENTS

| | | |
|---|---|---|
| EP | 2 280 787 B1 | 6/2014 |
| GB | 1 470 693 | 4/1977 |
| WO | 2005/009624 A1 | 2/2005 |

OTHER PUBLICATIONS

European Search Report, Application No. EP 15156544, 2 pages, dated Aug. 10, 2015.
(Continued)

*Primary Examiner* — Nicholas J Weiss
*Assistant Examiner* — Michael J Melaragno
(74) *Attorney, Agent, or Firm* — Hoffmann & Baron, LLP

(57) ABSTRACT

An applicator for spraying hair building solids is configured for one-handed operation and includes an applicator body which is connectable with a container including hair building solids. The applicator body includes a top part, a bottom part and a main part extending between the top part and the bottom part; an air pump electrically configured for creating an air flow; and a nozzle for spraying hair building solids out from the applicator. The bottom part includes an attachment structure for attaching the container to the applicator body, a first orifice in flow connection with the air pump for delivering air flow from the air pump via the bottom part and a second orifice in flow connection with the nozzle for delivering hair building solids via the bottom part to the nozzle.

27 Claims, 4 Drawing Sheets

(51) Int. Cl.

| | |
|---|---|
| ***B05B 1/02*** | (2006.01) |
| ***A45D 19/16*** | (2006.01) |
| ***B05B 11/06*** | (2006.01) |
| ***A45D 19/00*** | (2006.01) |
| ***A45D 34/04*** | (2006.01) |

(52) U.S. Cl.
CPC ..... *A45D 34/04* (2013.01); *B05B 1/02* (2013.01); *B05B 11/061* (2013.01); *A45D 2019/0058* (2013.01); *A45D 2200/057* (2013.01); *B05B 11/062* (2013.01)

(58) Field of Classification Search
USPC ..... 222/333
See application file for complete search history.

(56) References Cited

U.S. PATENT DOCUMENTS 2,029,408 A * 2/1936 Svend ..... B05B 7/1413 239/654
2,675,147 A 4/1954 Odom
2,792,151 A 5/1957 Wagner
3,223,329 A * 12/1965 Ross ..... B05C 19/001 222/333
3,586,215 A * 6/1971 Roche ..... A01M 9/0007 222/333
3,854,634 A * 12/1974 Hart ..... A01M 9/0092 33/721
5,014,884 A * 5/1991 Wunsch ..... B05B 9/0866 222/333
5,310,095 A * 5/1994 Stern ..... B05B 1/02 222/402.1
6,053,436 A * 4/2000 Morford ..... A01C 15/04 222/333
6,837,447 B1 * 1/2005 Clark ..... A01M 7/0003 239/142
7,140,522 B2 * 11/2006 Kress ..... A45D 19/16 132/201
8,172,115 B1 * 5/2012 Mulhauser ..... B05B 11/061 222/209
8,272,584 B2 * 9/2012 Barnett ..... A01C 7/02 222/317
2015/0201732 A1 * 7/2015 Kakon ..... A45D 33/02 222/333
2016/0243566 A1 * 8/2016 Martiskainen ..... A45D 19/0008

OTHER PUBLICATIONS

European Office Action, Application No. EP 15156544, 3 pages, dated Sep. 11, 2015.

* cited by examiner

APPLICATOR

CROSS-REFERENCE TO RELATED APPLICATION

This application claims priority to European Patent Application No. 15156544.7, filed Feb. 25, 2015, which is incorporated by reference herein in its entirety.

BACKGROUND

Field

The present invention relates to an area of cosmetic treatment for hair loss and especially to an applicator for spraying hair building solids, more particularly to an applicator which is configured for one-handed operation and is defined in the independent claim 1.

Description of the Related Art

Different applicators for hair building solids are known in the prior art which with the help of air suspend hair building solids from the applicator onto a human scalp for covering areas of the scalp which do not comprise hair.

Publication WO 2005/009624 shows an applicator which is operated with both hands such that one hand holds the applicator and the other hand squeezes a rubber bulb in order to create an air flow through an air supply tube to a container comprising hair building solids and from the container through a tube out from the applicator.

One of the problems with the above mentioned applicator is that the applicator user has to use both hands to operate the applicator. This is especially undesirable when spraying hair building solids because the user normally wants to use the free hand to reshape the hair.

Publication EP 2280787 discloses another kind of applicator for hair building solids in which the applicator is operated and aimed with one hand. A bulb that provides air for suspending the hair building solids is located directly on top of an applicator body. The bulb can be depressed by a single finger when the applicator is held in one hand. When the compressed air exits the bulb, it follows a direct straight downward pathway to the surface of the hair building solids. Air exits the bulb and passes through an air injecting orifice that is directed towards a surface of a mass of hair building solids suspending the solids within the turbulently pressurized applicator. Hair building solids are then directed smoothly by the domed undersurface of the applicator body into the straight bore of a short nozzle.

One of the problems associated with the above applicator is that when using the applicator a normal working position follows the shape of the scalp which means that the applicator has to be in an inclined position and cannot be used in a vertical position all the time. The inclined position causes clogging in the nozzle preventing hair building solids to come out from the nozzle and thereby makes the outcome unsatisfactory.

SUMMARY

An object of the present invention is thus to provide an applicator for spraying hair building solids so as to overcome the above disadvantages. The object of the invention is achieved by an applicator which is characterized by what is stated in the independent claim. The preferred embodiments of the invention are disclosed in the dependent claims.

The invention is based on the idea of providing an applicator for spraying hair building solids which the applicator is configured for one-handed operation and comprises an applicator body which is connectable with a container comprising hair building solids. The applicator body comprises a top part, a bottom part and a main part extending between the top part and the bottom part; an air pump electrically configured for creating an air flow and a nozzle for spraying hair building solids out from the applicator. The bottom part comprises an attachment structure for attaching the container to the applicator body, a first orifice in flow connection with the air pump for delivering air flow from the air pump via the bottom part and a second orifice in flow connection with the nozzle for delivering hair building solids via the bottom part to the nozzle.

The first orifice is for delivering air flow from the air pump to the container when the container is attached to the applicator body and the second orifice is for delivering a mixture of hair building solids and air from the container to the nozzle and out from the applicator. The first orifice is smaller in diameter than the second orifice. The applicator body further comprises a first channel extending between the air pump and the first orifice and a second channel extending between the second orifice and the nozzle. The first channel preferably comprises a first channel part which is part of the bottom part and a second channel part extending between the first channel part and the air pump. In a preferred embodiment of the invention the first channel part is inclined such that the air flow coming from the air pump is directed toward that side wall of the container which is nearest to the first orifice. In other words the inclination of the first channel part is preferably such that the air flow coming through the first channel part and through the first orifice is directed toward that part of the bottom of the container which is closer to the wall of the container on the side of the first orifice and not toward that part of the bottom of the container which is closer to the middle point of the bottom of the container. In still another words, the inclination of the first channel part is away from the middle point of the container such that the air flow coming through the first orifice is directed away from the central axis of the container. The central axis is the vertical axis coming from the midpoint of the bottom of the container and through the container in vertical direction. In still another words, the first channel part is inclined away from a midpoint of the bottom part in a flow direction. In a preferred embodiment of the invention the first channel part is tapered toward the first orifice. This is especially advantageous because the velocity of the air flow is increased in the area of the first orifice when the tube narrows toward the first orifice.

In one embodiment of the invention the first channel part is inclined toward a bottom corner of the container which the bottom corner of the container is the point in which the side wall of the container and the bottom of the container interconnect. The side of the container which is nearest to the first orifice is preferably the same side in which the nozzle is arranged in the applicator body. In other words, if the applicator body is imaginarily divided into half through a vertical plane, the nozzle and the first orifice are on the same side of the applicator body and the second orifice is on the other side of the applicator body than the first orifice. The side of the applicator body in which the nozzle is arranged is called a front side and the opposite side is called a back side. The front side is normally kept toward the scalp to be treated. The front side of the container is the part of the container which when the container is attached to the applicator body is on the same side with the nozzle. Because of the inclination of the first channel part the air flow coming from the air pump reaches the front side of the container, the front side being the side which is closest to the first orifice.

Normally the applicator body is inclined forward so that the nozzle faces toward the scalp to be sprayed which means that due to gravity the hair building solids will move forward towards the side of the container nearest to the first orifice, i.e. towards the front side of the container. Thereby the air flow coming from the first orifice blows the hair building solids more effectively and causes turbulence which helps to move the hair building solids toward the second orifice for delivering the hair building solids to the nozzle and through the nozzle to the scalp. By directing the air flow toward the front side of the container also prevents the air flow from interfering to the movement of the mixture of hair building solids and air moving upward to the second orifice. The air pump of the applicator is electrically configured for creating an air flow. Therefore the applicator preferably comprises a rechargeable battery within the applicator body so that it can be used cordlessly. The applicator also comprises one or more push button or like for operating the air pump or controlling the air flow coming from the air pump. The applicator further comprises a circuit board and other electrical configurations for operating the air pump. The applicator further comprises a container comprising hair building solids.

The first orifice arranged in the bottom part of the applicator body is arranged on the same side of the applicator body as the nozzle. Further the first channel extending between the air pump and the first orifice is arranged on the same side of the applicator body as the nozzle. This means that when a user of the applicator directs the nozzle toward the scalp to be treated the applicator body together with the container comprising hair building solids is aligned such that the hair building solids move to that part of the container which is nearest to the first orifice of the applicator body so that the air coming from the air pump hits the hair building solids and creates vortexes in the hair building solids such that they can freely flow toward the second orifice without clogging it and then flow along the second channel to the nozzle and out from the nozzle to the scalp to be treated. The nozzle is typically aligned such that the hair building solids come out from the nozzle to the scalp from above because the hair loss typically occurs on top of the head.

Further the second channel extending from the second orifice to the nozzle is arranged to extend on the side of the applicator body which is opposite to the side on which the nozzle is arranged and further to extend on the top part of the applicator body substantially on the same direction as the nozzle such that the part of the second channel extending from the nozzle channel as a parallel channel extends until it turns toward the container on the opposite side of the applicator body than where the nozzle protrudes out from the applicator body.

An advantage of the applicator of the invention is that the applicator makes possible dispersing hair building solids onto the scalp one-headedly so that a hand position of the user is both ergonomic and natural because the applicator can be inclined according to the shape of the scalp without being clogged. Another advantage of the invention is that the applicator comprises an air pump which is electrically configured for creating an air flow so that the user only has to give an activation signal in order to create an air flow inside the applicator and to supply hair building solids. This removes the need for pumping a bulb or similar with a finger which tires out the finger.

BRIEF DESCRIPTION OF THE DRAWINGS

In the following the invention will be described in greater detail by means of preferred embodiments with reference to the accompanying drawings, in which.

DETAILED DESCRIPTION

Figure 1:
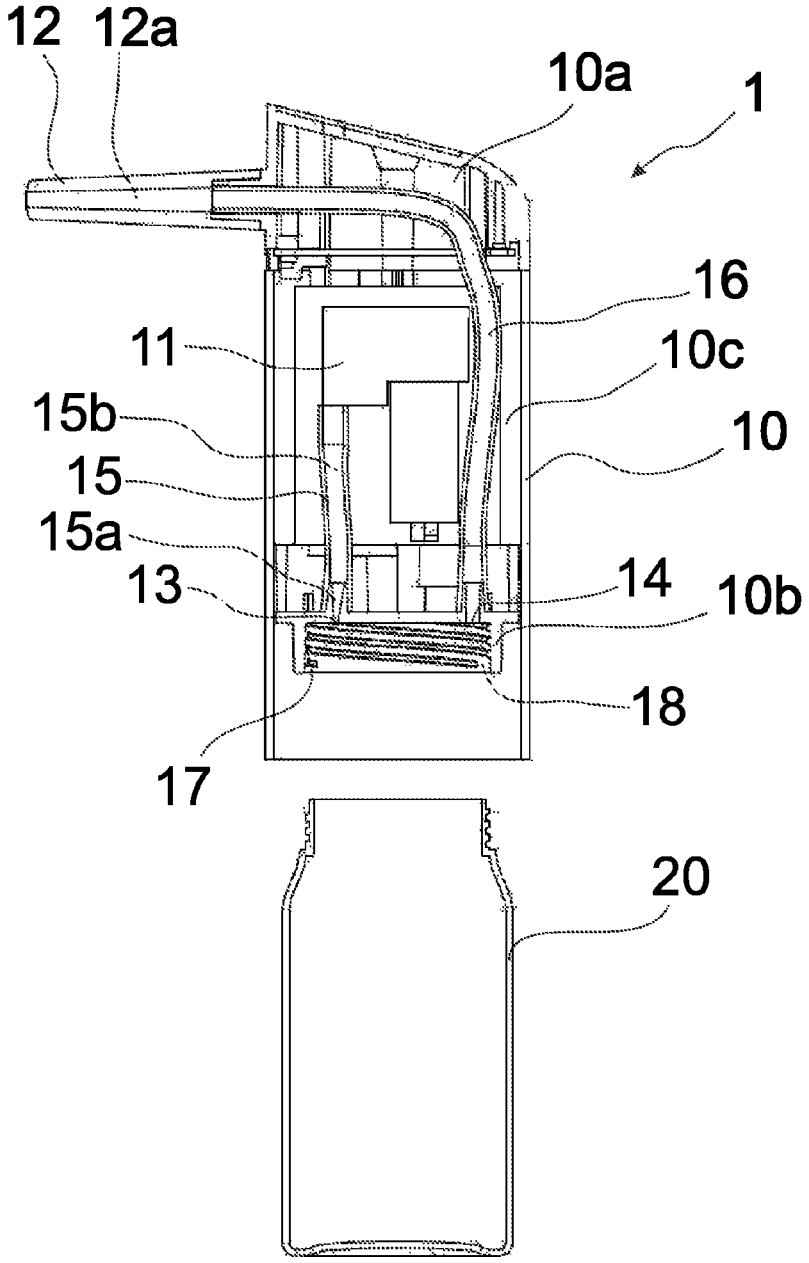
FIG. 1 shows an applicator according to the invention in which the applicator body and the container are disassembled.

FIG. 1 shows the applicator 1 according to the invention which comprises an applicator body 10. The applicator body 10 is connectable with a container 20 comprising hair building solids (hair building solids are not shown in this figure). The applicator body 10 comprises a top part 10*a*, a bottom part 10*b* and a main part 10*c* extending between the top part 10*a* and the bottom part 10*b*. The top part 10*a* comprises a nozzle 12, the bottom part 10*b* comprises an attachment structure 17 for attaching the applicator body 10 to the container 20. The main part 10*c* of the applicator body 10 comprises an air pump 11 and a first channel 15 extending between the air pump 11 and a first orifice 13. The applicator body 10 further comprises a second channel 16 extending between a second orifice 14 and the nozzle 12. Part of the second channel 16 is arranged to extend in the top part 10*a* of the applicator body 10 such that it extends from the nozzle 12 in a first direction which is substantially the same direction with the nozzle channel 12*a* until the second channel 16 is arranged to turn in a second direction which is substantially transverse, for example substantially perpendicular, to the first direction and toward the container 20.

The second channel 16 comprises a first channel section and a second channel section which the first channel section extends in the top part from the nozzle channel 12*a* and substantially parallel to the nozzle channel 12*a*. The second channel section extends through the main part 10*c* of the applicator body 10 from the second orifice 14 to the top part 10*a* of the applicator body 10. The second channel section is arranged to extend transverse to the first channel section, preferably perpendicular to the first channel section.

The applicator body 10 can be made from plastics or metal or some other suitable material and the applicator body 10 may comprise different materials, for example the top part 10*a*, the main part 10*c* and the bottom part 10*b* can all be made from different materials. In a preferred embodiment of the invention the main part 10*c* is made from metal and especially from aluminium. The main part 10*c* is most preferably made as an extruded aluminium profile. In a preferred embodiment of the invention the top part 10*a* and the bottom part 10*b* are preferably made form plastics with injection moulding. The top part 10*a* and the bottom part 10*b* are preferably connected to the main part 10*c* through a screw connection. The top part 10*a*, the bottom part 10*b* and the main part 10*c* can also be connected mechanically in another way for example the parts can be clamped together or when not connected mechanically the parts can be connected by gluing. The tops part 10*a*, bottom part 10*b* or the main part 10*c* may be formed from several parts which in turn may be connected together through a screw connection or by gluing.

The applicator body 10 further comprises a nozzle 12 for spraying hair building solids out from the applicator 1. The nozzle 12 is preferably arranged in the top part 10*a* of the applicator body 10 protruding from the top part 10*a*. The nozzle 12 is preferably detachably connected to the applicator body 10 such that it can be removed from the applicator 1 and connected to the applicator 1, e.g. when replaced for a new one or for cleaning purposes. In other words, the nozzle 12 is removable from the applicator 1. The nozzle 12 has preferably a conical shape, but the shape and the size of the nozzle 12 may vary. The nozzle 12 is preferably made from plastics with injection moulding. The nozzle 12 comprises a nozzle channel 12*a* inside the nozzle 12.

The applicator body 10 further comprises an air pump 11 electrically configured for creating an air flow. The air pump 11 is preferably arranged in the main part 10*c* of the applicator body 10. The air pump 11 has an adjustable flow rate; most preferably the flow rate is 3 liters per minute. The air pump 11 is preferably an electric diaphragm pump which gets power from a battery and preferably from a rechargeable battery, e.g. a lithium-ion battery. The applicator body may further comprise a USB charging port having a band part for recharging the battery. The USB charging port is preferably made from plastics with injection moulding. The USB band part is preferably made from plastics with injection moulding. The applicator body 10 further comprises switch for electronics and controlling means which preferably are located at the top part 10*a* of the applicator body 10. There can also be an indicator for a battery state of charge and a battery charge status and buttons for air pump 11 voltage control. The switches and buttons may be made as membrane switches and buttons. The speed of the hair building solids coming out from the applicator 1 can be adjusted by controlling the air pump 11 through the buttons on the applicator 1. Another possible location for the switch and buttons could be in the back side of the main part 10*c*.

FIG. 1 further shows a container 20 which is preferably made from plastics with blow moulding. Plastics are not the only material option for the container 20 and it can also be made from metal such as aluminium or from plastics with another method. The bottom part 10*b* of the applicator body 10 comprises an attachment structure 17 for attaching the container 20 to the applicator body 10. The attachment structure 17 is preferably threads for the container 20 comprising corresponding threads. The bottom part 10*b* further comprises a first orifice 13 in flow connection with the air pump 11 for delivering air flow from the air pump 11 via the bottom part 10*b* to the container 20 when it is attached to the applicator body 10 and a second orifice 14 in flow connection with the nozzle 12 for delivering hair building solids via the bottom part 10*b* to the nozzle 12. The first orifice 13 is smaller in diameter than the second orifice 14. The flow connection between the first orifice 13 and the air pump 11 is arranged with a first channel 15 extending between the air pump 11 and the first orifice 13 and the flow connection between the second orifice 14 and the nozzle 12 is arranged with a second channel 16 extending between the second orifice 14 and the nozzle 12. The first and the second channel 15, 16 may comprise multiple channel parts. In FIG. 1 is shown that the first channel 15 comprises a first channel part 15*a* and a second channel part 15*b*. The first channel part 15*a* in this embodiment of the invention is arranged as part of the bottom part 10*b* comprising the first orifice 13 and protruding from the bottom part 10*b* toward the air pump 11. The second channel part 15*b* is preferably an air hose connected to the air pump 11 and to the first channel part 15*a*. The second channel 16 is in this embodiment of the invention an air hose connected to the second orifice 14 in the bottom part 10*b* and to the nozzle 12. The second channel 16 may also comprise several parts such that one part of the second channel is arranged in the bottom part 10*b* similarly as in connection with the first orifice 13. FIG. 1 also shows that the bottom part 10*b* is formed to comprise a recess 18 for receiving the container 20. The attachment structure 17 is arranged in the recess 17.

Figure 2:
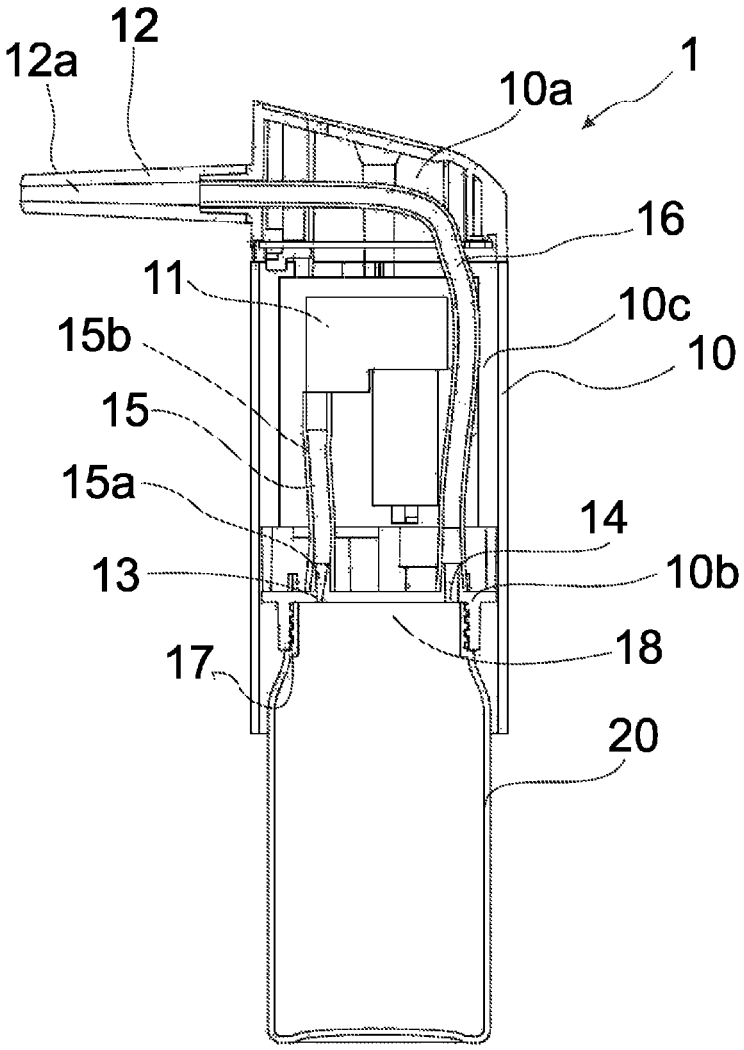
FIG. 2 shows an applicator according to the invention in which the applicator body and the container are assembled.

FIG. 2 shows the applicator 1 in which the applicator body 10 and the container 20 are assembled, i.e. connected together, so that the applicator 1 is ready for use, i.e. for spraying hair building solids. As already explained in connection with FIG. 1 the applicator 1 preferably comprises one or more buttons for operating the applicator 1. When the user starts to use the applicator 1 the user presses a button with a finger and the air pump 11, which is preferably an electric diaphragm pump, creates air pressure. The user can also adjust the speed of the applicator supplying hair building solids by pushing a control button. Air flow is then passed into the first channel 15 extending between the air pump 11 and the first orifice 13. In this embodiment of the invention the first channel 15 comprises a first channel part 15*a* and a second channel part 15*b* such that the first channel part 15*a* forms part of the bottom part 10*b*. The second channel part 15*b* is an air hose connected to the air pump 11 and to the first channel part 15*a*. In this embodiment of the invention the first channel part 15*a* is formed conically such that it tapers toward the first orifice 13 such that the velocity of the air flow is increased due to Venturi effect. In other embodiments of the invention the first channel part 15*a* can be a tubular channel or only partly inclined channel. The first channel part 15*a* ends into the first orifice 13. The size of the first channel part 15*a* as well as the size of the first orifice 13 is optimized for the chosen air pump 11 and vice versa. Air flow coming from the air pump 11 passes through the first orifice 13 and blasts into the container 20 which is filled with hair building solids. The container 20 is arranged in the recess 18 of the applicator body 10 and is securely held there with the attachment structure 17 which in this embodiment is the threads in the bottom part 10*b* of the applicator body 10 and in the upper part of the container 20. The air flow coming through the first orifice 13 causes an increase in the air pressure inside the container and therefore the mixing of air and hair building solids is improved. The diameter of the first orifice 13 is 0.5-1.5 mm and the diameter of the second orifice 14 is 2-4 mm. The first orifice 13 is preferably arranged in the bottom part 10*b* such that the centre of the first orifice 13 is in a distance away from the attached container 20 wall, this distance being from 2 to 10 mm, preferably from 4 to 8 mm and most preferably 5 mm. This together with the inclined first channel part 15*a* which the first channel part 15*a* is inclined away from the midpoint of the container 20 ensures an unobstructed pathway for the air flow and enhances producing a mixture of air and hair building solids that become turbulent and try to exit the container 20 due to increased air pressure. The mixture of hair building solids and air move toward the second orifice 14 because of increased air pressure and through the second orifice 14 into the second channel 16. The diameter of the second orifice 14 is also optimized for the chosen air pump 11, but also for the size of the first orifice 13 and the composition of the hair building solids. The second orifice 14 is however bigger in diameter than the first orifice 13.

As can be seen from the figures the first orifice 13 is located on the same side of the applicator body 10 as the nozzle 12 and the second orifice 14 is located on the opposite side of the applicator body 10. In other words the second orifice 14 is arranged on the opposite side of the bottom part 10*b* than the first orifice 13. This is the most preferable arrangement because of a natural inclination of the applicator 1 when it is used. Increased air pressure causes the mixture of hair building solids and air to pass through the second channel 16 which is preferably an air hose. The second channel 16 starts from the second orifice 14 into which it is connected and ends to the nozzle 12 such that the second channel 16 extends as the nozzle channel 12*a* in the nozzle 12. The second channel 16 and the nozzle 12 are connected together. The hair building solids together with air move from the second channel 16 to the nozzle channel 12*a* in the nozzle 12. The inner diameter of the nozzle channel 12*a* inside the nozzle 12 is preferably equivalent to the inside diameter of the second channel 16. The nozzle channel 12*a* preferably narrows toward the end wherefrom the hair building solids are supplied which makes the spray of the hair building solids more focused.

Figure 3:
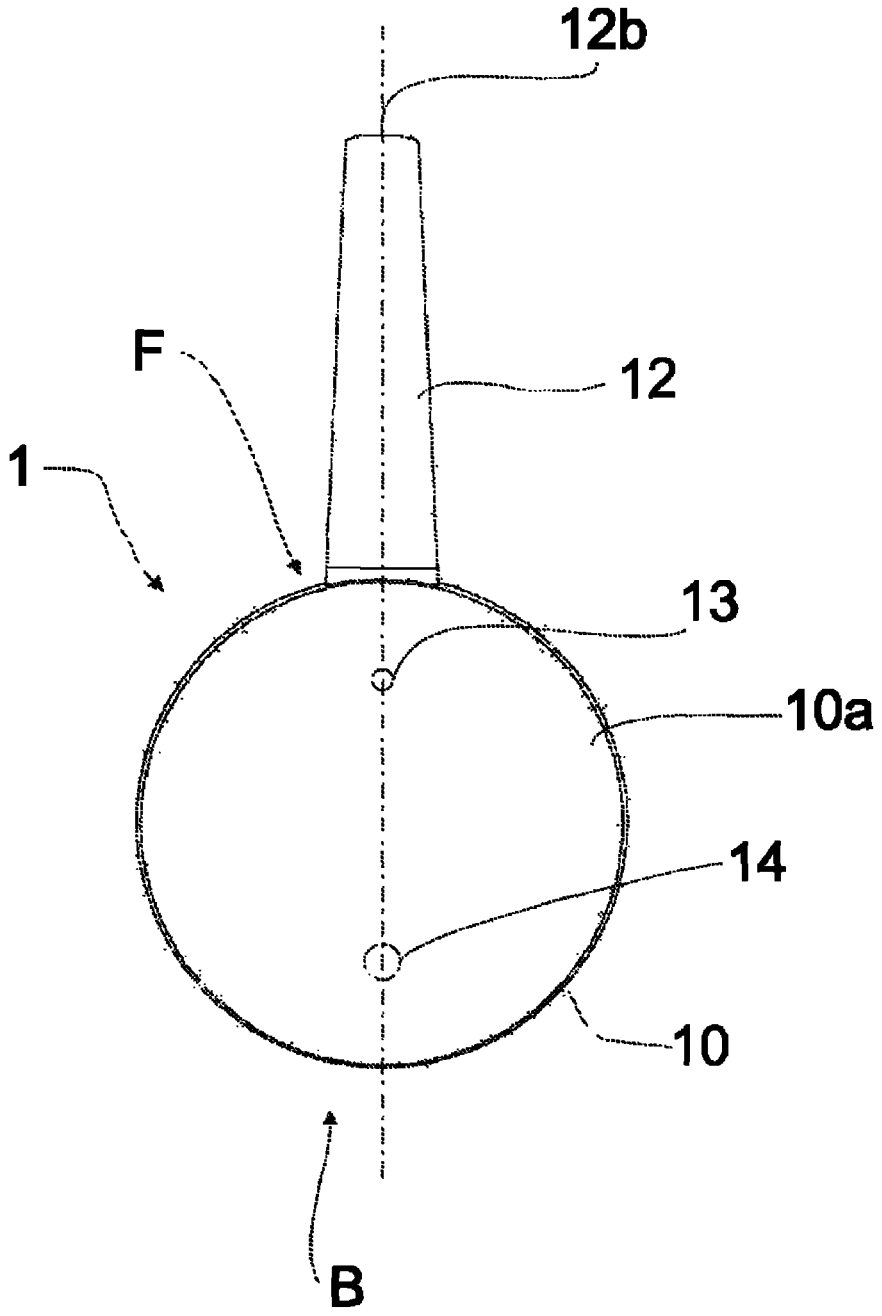
FIG. 3 shows an applicator as a top projection.

FIG. 3 shows the applicator 1 as a top projection. The applicator 1 comprises the applicator body 10 and in this figure the top part 10*a* of the applicator body 10 is shown. The applicator body 10 comprises a nozzle 12 for spraying hair building solids out from the applicator 1. The nozzle 12 may be of another shape than that shown in this figure but the nozzle 12 is preferably arranged such that the first orifice 13 and the second orifice 14 are in line with an opening 12*b* in the nozzle 12 when seen above the applicator 1. In other words the first orifice 13 and the second orifice 14 are arranged in line such that the line is parallel to a nozzle channel 12*a* inside the nozzle 12. The opening 12*b* is the orifice wherefrom the hair building solids come out from the applicator 1. The first and the second orifice 13, 14 are shown with a dashed line because they cannot be actually seen when looking at the applicator 1 from above. The first orifice 13 which is smaller in diameter than the second orifice 14 is preferably arranged closer to the nozzle 12 than the second orifice 14. The nozzle 12, the first orifice 13 and the second orifice 14 are preferably aligned in the same line when seen from above. The first orifice 13 which is arranged in the bottom part 10*b* of the applicator body 10 is preferably arranged in the bottom part 10*b* closer to that side of the applicator body 10 wherefrom the nozzle 12 protrudes out from the applicator 1. In other words, the first orifice 13 is arranged closer to that side of the applicator body 10 wherefrom the nozzle 12 is arranged to protrude than where the second orifice 14 is arranged. In still other words the first orifice 13 is arranged in the bottom part 10*b* closer to that side of the applicator body 10 where the nozzle 12 protrudes from the applicator 1 and the second orifice 14 is arranged on the other side of the bottom part 10*b*. The side of the applicator 1 wherefrom the nozzle 12 protrudes is the front side F and opposite to the front side F is the back side B. The first orifice 13 is then arranged in the bottom part 10*b* closer to the front side F than the back side B and the second orifice 14 is arranged closer to the back side B than the front side F. So the air pump 11 and the first orifice 13 are arranged in the front side F part of the applicator body 10 and the second orifice 14 is arranged to the back side B part of the applicator body 10 and the nozzle 12 protrudes from the front side F of the applicator body 10. When the applicator body 10 is viewed from above or from below the first orifice 13 is closer to the nozzle 12 than the second orifice 14.

In the main part of the applicator body 10 the first channel 15 is arranged closer to the nozzle 12 than the second channel 16. Further in the main part of the applicator body the first channel 15 is closer to the front side of the applicator body, i.e. closer to the part wherefrom the nozzle 12 protrudes, and the second channel 16 is closer to the back side B of the applicator body. The first channel 15 is closer to the front side than the back side B and the second channel 16 is closer to the back side B than the front side F. The first orifice 13 is closer to the front side F than the back side B and the second orifice 14 is closer to the back side B than the front side F.

Figure 4A:
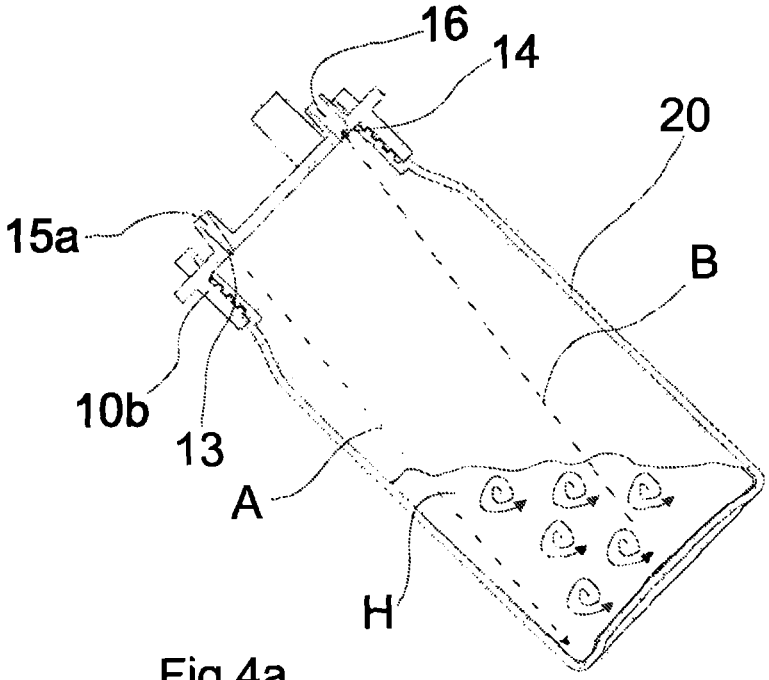
FIG. 4*a* shows the container together with the bottom part of the applicator body.

FIG. 4*a* shows the bottom part 10*b* of the applicator body 10 and the container 20 comprising hair building solids. The bottom part 10*b* and the container 20 are connected together through a thread connection. The hair building solids are referred with letter H in this figure. The container 20 is arranged in an inclined position in this figure because the inclined position is quite natural position when using the applicator 1. Only the bottom part 10*b* of the applicator 1 is shown for the sake of clarity but naturally when using the applicator 1 also the other parts of the applicator 1 are included. The dashed line A illustrates how the air flow from the air pump comes into the container 20. The air flow comes through the first channel part 15*a* of the bottom part 10*b*. The first channel part 15*a* is arranged in an inclined position facing away from the midpoint of the bottom part 10*b* when extending toward the container 20. Because of the inclined position of the first channel part 15*a* the air flow comes closer to the front side of the container 20 (shown with the dashed line A). In the normal use position of the applicator 1 in which the applicator is inclined forward to the front side in which the nozzle 12 is arranged the hair building solids move also forward towards the first orifice 13 due to gravity. This may cause the first orifice 13 to become blocked by a turbulent hair building solids mixture or by the hair building solids level in the container 20 or by both. As a solution for the blocking problem the first channel part 15*a* is inclined so that the air flow creates whirling movement inside the container 20 away from the first orifice 13. The second orifice 14 is arranged in the bottom part 10*b* closer to the back side of the applicator 1, the back side being the side opposite to the side wherefrom the nozzle 12 protrudes. The whirling hair building solids and air mixture move toward the second orifice 14 and exit through it from the container 20 to the applicator body 10 and through the second channel and nozzle onto the scalp to be treated.

Figure 4B:
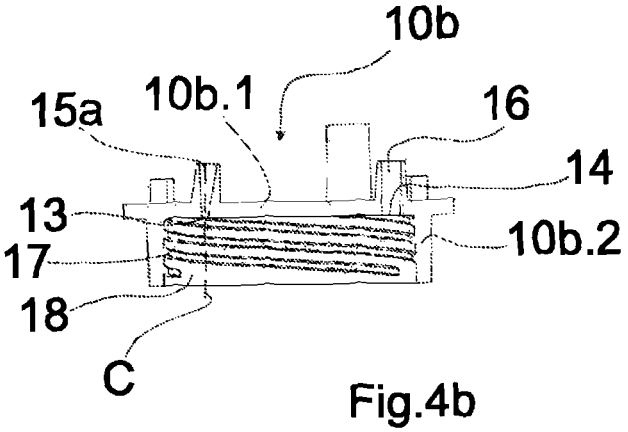
FIG. 4*b* shows the bottom part of the applicator body.

FIG. 4*b* shows the bottom part 10*b* of the applicator body 10. As already explained above the bottom part 10*b* comprises the first orifice 13 and the second orifice 14. The bottom part 10*b* comprises a top wall 10*b*.1 and one or more side walls 10*b*.2 extending from the top wall 10*b*.1. When the applicator body 10 is tubular there is in fact only one side wall 10*b*.1 extending around the top wall 10*b*.1. The one or more side wall 10*b*.2 protrudes from the top wall 10*b*.1 away from the rest of the applicator body 10. The side walls 10*b*.2 form the recess 18 in which the container 20 is attached through the attachment structure 17. The first orifice 13 is preferably arranged in the bottom part 10*b* of the applicator body 10 such that the centre of the first orifice 13 is from 4 to 12 mm from the side wall 10*b*.2 and preferably 6 to 10 mm and most preferably 7 to 9 mm from the side wall 10*b*.2, which the side wall 10*b*.2 is that on the same side as the front side of the applicator 1. The dashed line C shows the centre of the first orifice 13. The second orifice 14 is preferably arranged in the bottom part 10*b* such that the centre of the second orifice 14 is from 1 to 6 mm from the side wall 10*b*.2 and preferably 1.5 to 5 mm and most preferably 2 to 4 mm from the side wall 10*b*.2, which the side wall 10*b*.2 is in that case the side wall 10*b*.2 on the same side as the back side of the applicator 1. The first channel part 15*a* is arranged to incline toward the front side of the container 20 or in other words toward the front side wall 10*b*.2 of the bottom part 10*b*. Besides the inclination the first channel part 15*a* is also arranged to narrow toward the first orifice 13. The second channel 16 extending from the second orifice 14 is preferably tubular. In another embodiment of the invention the first orifice 13 is arranged in the top wall 10*b*.1 such that the centre of the first orifice 13 is spaced apart at least 3 mm, preferably 6 mm, from the one or more side walls 10*b*.2.

It will be obvious to a person skilled in the art that, as the technology advances, the inventive concept can be implemented in various ways. The invention and its embodiments are not limited to the examples described above but may vary within the scope of the claims.

The invention claimed is:

1. An applicator for spraying hair building solids, the applicator configured for one-handed operation and comprises an applicator body which is connectable with a container comprising hair building solids, the applicator body comprising:

a top part, a bottom part and a main part extending between the top part and the bottom part;

an air pump electrically configured for creating an air flow; and a nozzle for spraying hair building solids out from the applicator, the bottom part comprising an attachment structure for attaching the container to the applicator body, a first orifice in flow connection with the air pump for delivering air flow from the air pump via the bottom part and a second orifice in flow connection with the nozzle for delivering hair building solids via the bottom part to the nozzle, wherein the first orifice is arranged closer to that side of the applicator body wherefrom the nozzle is arranged to protrude than where the second orifice is arranged.

2. An applicator according to claim 1, wherein the first orifice is smaller in diameter than the second orifice.

3. An applicator according to claim 1, wherein the diameter of the first orifice is 0.5-1.5 mm and the diameter of the second orifice is 2-4 mm.

4. An applicator according to claim 1, wherein the second orifice is arranged on the opposite side of the bottom part than the first orifice.

5. An applicator according to claim 1, wherein the first orifice and the second orifice are arranged in line such that the line is parallel to a nozzle channel inside the nozzle.

6. An applicator according to claim 1, wherein the bottom part comprises a recess for receiving the container.

7. An applicator according to claim 1, wherein the bottom part comprises a top wall and one or more side walls extending from the top wall, the first orifice is arranged in the top wall such that the centre of the first orifice is spaced apart at least 3 mm, preferably 6 mm, from the one or more side walls.

8. An applicator according to claim 1, wherein the applicator further comprises the container.

9. An applicator according to claim 1, wherein the nozzle is removable from the applicator.

10. An applicator for spraying hair building solids, the applicator configured for one-handed operation and comprises an applicator body which is connectable with a container comprising hair building solids, the applicator body comprising:

a top part, a bottom part and a main part extending between the top part and the bottom part;

an air pump electrically configured for creating an air flow; and a nozzle for spraying hair building solids out from the applicator, the bottom part comprising an attachment structure for attaching the container to the applicator body, a first orifice in flow connection with the air pump for delivering air flow from the air pump via the bottom part and a second orifice in flow connection with the nozzle for delivering hair building solids via the bottom part to the nozzle, wherein the applicator body further comprises a first channel extending between the air pump and the first orifice and a second channel extending between the second orifice and the nozzle, wherein the first channel comprises a first channel part which is part of the bottom part and a second channel part extending between the first channel part and the air pump, wherein the first channel part is tapered toward the first orifice.

11. An applicator according to claim 10, wherein the first orifice is smaller in diameter than the second orifice.

12. An applicator according to claim 10, wherein the diameter of the first orifice is 0.5-1.5 mm and the diameter of the second orifice is 2-4 mm.

13. An applicator according to claim 10, wherein the second orifice is arranged on the opposite side of the bottom part than the first orifice.

14. An applicator according to claim 10, wherein the first orifice and the second orifice are arranged in line such that the line is parallel to a nozzle channel inside the nozzle.

15. An applicator according to claim 10, wherein the bottom part comprises a recess for receiving the container.

16. An applicator according to claim 10, wherein the bottom part comprises a top wall and one or more side walls extending from the top wall, the first orifice is arranged in the top wall such that the centre of the first orifice is spaced apart at least 3 mm, preferably 6 mm, from the one or more side walls.

17. An applicator according to claim 10, wherein the applicator further comprises the container.

18. An applicator according to claim 10, wherein the nozzle is removable from the applicator.

19. An applicator for spraying hair building solids, the applicator configured for one-handed operation and comprises an applicator body which is connectable with a container comprising hair building solids, the applicator body comprising:

a top part, a bottom part and a main part extending between the top part and the bottom part;

an air pump electrically configured for creating an air flow; and a nozzle for spraying hair building solids out from the applicator, the bottom part comprising an attachment structure for attaching the container to the applicator body, a first orifice in flow connection with the air pump for delivering air flow from the air pump via the bottom part and a second orifice in flow connection with the nozzle for delivering hair building solids via the bottom part to the nozzle, wherein the applicator body further comprises a first channel extending between the air pump and the first orifice and a second channel extending between the second orifice and the nozzle, wherein the first channel comprises a first channel part which is part of the bottom part and a second channel part extending between the first channel part and the air pump wherein the first channel part is inclined away from a midpoint of the bottom part in a flow direction.

20. An applicator according to claim 19, wherein the first orifice is smaller in diameter than the second orifice.

21. An applicator according to claim 19, wherein the diameter of the first orifice is 0.5-1.5 mm and the diameter of the second orifice is 2-4 mm.

22. An applicator according to claim 19, wherein the second orifice is arranged on the opposite side of the bottom part than the first orifice.

23. An applicator according to claim 19, wherein the first orifice and the second orifice are arranged in line such that the line is parallel to a nozzle channel inside the nozzle.

24. An applicator according to claim 19, wherein the bottom part comprises a recess for receiving the container.

25. An applicator according to claim 19, wherein the bottom part comprises a top wall and one or more side walls extending from the top wall, the first orifice is arranged in the top wall such that the centre of the first orifice is spaced apart at least 3 mm, preferably 6 mm, from the one or more side walls.

26. An applicator according to claim 19, wherein the applicator further comprises the container.

27. An applicator according to claim 19, wherein the nozzle is removable from the applicator.

* * * * *